US005595633A

United States Patent [19]

Sogame et al.

[11] Patent Number: 5,595,633

[45] Date of Patent: Jan. 21, 1997

[54] COKING PROCESS FOR A BATTERY OF COKE OVENS

[75] Inventors: Shingo Sogame; Masatsugu Kimura, both of Sakaide, Japan

[73] Assignee: Mitsubishi Chemical Corporation, Tokyo, Japan

[21] Appl. No.: 332,494

[22] Filed: Oct. 31, 1994

Related U.S. Application Data

[63] Continuation of Ser. No. 958,761, Oct. 9, 1992, abandoned.

[30] Foreign Application Priority Data

Oct. 11, 1991 [JP] Japan ..... 3-263996

[51] Int. Cl.[6] ..... C10B 31/00

[52] U.S. Cl. ..... 201/1; 201/26; 201/41

[58] Field of Search ..... 201/1, 26, 41

[56] References Cited

U.S. PATENT DOCUMENTS

| | | | |
|---|---|---|---|
| 4,021,309 | 5/1977 | Radstake et al. | 201/1 |
| 4,045,292 | 8/1977 | Matsushita et al. | 201/1 |
| 4,071,414 | 1/1978 | Fidchunov et al. | 201/40 |
| 4,086,143 | 4/1978 | Echterhoff et al. | 201/41 |
| 4,102,751 | 7/1978 | Stalherm et al. | 201/26 |
| 4,111,756 | 9/1978 | Lagemann et al. | 201/41 |
| 4,568,424 | 2/1986 | Bauer | 201/1 |

OTHER PUBLICATIONS

Cooper, *By–Product Coking*, 1923, pp. 30 and 31.

*Primary Examiner*—Virginia Manoharan

*Attorney, Agent, or Firm*—Oblon, Spivak, McClelland, Maier & Neustadt, P.C.

[57] ABSTRACT

A method for operating a battery of coke ovens capable of accomplishing an increase in production and a decrease in the quantity of heat required for carbonization. The battery of cove ovens include a plurality of carbonization chambers to which a series of working numbers indicating the order of unit oven workings are assigned. An operation step is repeatedly practiced which includes a working step of carrying out the unit oven workings in the order of working numbers with respect to the carbonization chambers without providing a working interrupting time between the unit oven workings and an interruption step of interrupting the unit oven working until the the carbonization chamber of the coke oven which has been first subject to the unit oven working reaches a time at which discharge from the carbonization chamber is made possible.

8 Claims, 6 Drawing Sheets

NUMBER OF CARBONIZATION CHAMBERS : 100,
RATE OF OPERATION : 132%,
OVEN DISCHARGE CYCLE: 18.18 HRS. AFTER CHARGING START (CONSTANT)

COKING PROCESS FOR A BATTERY OF COKE OVENS

This application is a Continuation of application Ser. No. 07/958,761, filed on Oct. 9, 1992, now abandoned.

BACKGROUND OF THE INVENTION

This invention relates to a method for operating a battery of coke ovens, and more particularly to a coke oven operating method which accomplishes an increase in production and a decrease in quantity of heat required for carbonization.

Conventionally, the operation of a coke oven is carried out according to a schedule for charging and discharging operations with respect to a battery of coke ovens (hereinafter referred to as "oven charge-discharge schedule") which is prepared so as to properly distribute the number of operations per one day among working teams, to thereby permit operators to take a rest during working and the amount of working to be equalized among the working teams. Also, the oven charge-discharge schedule is so prepared that the number of operations is distributed depending on working hours for each of former and latter halves of the working with a rest period being interposed therebetween.

FIG. 3 illustrates an example of such an oven charge-discharge schedule, wherein the number of carbonization chambers is set to be 100 and the number of operations per one day is set to be 132. In FIG. 3, a laterally extending line on an upper stage indicates a series of continuous unit oven workings of the previous day and a laterally extending line on a lower stage is a series of continuous unit oven workings of the day. A space between the upper line and the lower line indicates a period of time required for shifting between working teams and a rest period for each of the working teams. Feedstock coal charged in a coke oven at times when oblique lines extending between the upper stage and the lower stage intersect the laterally extending line on the upper stage is discharged at times when the oblique lines intersect the line on the lower stage. The operating process of FIG. 3 will be referred to as "first process" hereinafter.

Another operating process is disclosed in Japanese Patent Application Laid-Open Publication No. 56588/1991 (3-56588), which comprises a process of calculating unit oven workings per one operational block based on a relationship between the number of operations per one day and the carbonization chambers installed. The operating process will be referred to as "second process" hereinafter. A further process comprises a so-called block operating process which is adapted to distribute installed carbonization chambers to each of operational blocks in a manner not to produce any surplus, as shown in FIG. 4. The process will be referred to as "third process" hereinafter.

Also, when the number of operators is sufficient to permit the operators to alternate in taking a rest, a continuous operating process is carried out wherein unit oven workings for a total amount of installed carbonization chambers are equally allotted on the basis of a target period of time between charging and discharging, to thereby eliminate an operation interrupting time. The process will be referred to as "fourth process" hereinafter.

Unfortunately, the conventional processes described above have the following disadvantages.

First, a cycle of discharge from an oven (hereinafter referred to as "oven discharge cycle") is kept constant throughout the carbonization chambers, resulting in a variation in carbonization time among the carbonization chambers, so that much labor is required to adjust heating conditions. Also, the oven discharge cycle for the same carbonization chamber is varied, therefore, adjustment of the heating conditions is restricted, leading to delay of carbonization and excessive carbonization which cause an increase in quantity of heat required for carbonization. Such disadvantage is peculiar to the first and second processes described above.

Also, in the first and second processes, the delay in carbonization and excessive carbonization cause a quality of coke produced to be deteriorated and varied.

In order to concentratedly repair the whole coke oven, it is required to change the oven charge-discharge schedule to ensure a repairing time of the order of 1 to 6 hours. Unfortunately, this causes the oven discharge cycle after restarting of the operation to be substantially varied, resulting in the quantity of heat being increased and the quality of coke being deteriorated and varied. Also, interruption of operation required for repairing the coke oven leads to a decrease in production of coke. Such disadvantage is common to the first to fourth processes. FIG. 6 shows an example of an oven charge-discharge schedule for the third process which is so prepared that the operation is interrupted for three hours.

SUMMARY OF THE INVENTION

The present invention has been made in view of the foregoing disadvantages of the prior art.

Accordingly, it is an object of the present invention to provide a method for operating a battery of coke ovens which is capable of decreasing a period of time and the quantity of heat which are required for carbonization.

It is another object of the present invention to provide a method for operating a battery of coke ovens which is capable of minimizing a variation in time for carbonization.

It is a further object of the present invention to provide a method for operating a battery of coke ovens which is capable of substantially reducing or minimizing a decrease in production due to repairing of a coke oven.

It is still another object of the present invention to provide a method for operating a battery of coke ovens which is capable of increasing a rate of operation of the coke ovens to accomplish an increase in production.

It is yet another object of the present invention to provide a method for operating a battery of coke ovens which is capable of significantly increasing a life of the coke ovens.

In accordance with the present invention, a method for operating a battery of coke ovens is provided, wherein the coke oven includes a plurality of carbonization chambers to which a series of numbers (hereinafter referred to as "working numbers") indicating the order of charge and discharge workings with respect to the carbonization chambers of the battery of coke ovens (with a charge step for an oven hereinafter referred to as a "unit oven workings") are assigned. The number of carbonization chambers is 70 to 150 and preferably 90 to 120. The method comprises repeating of an operation step comprising a working step of carrying out the unit oven workings in the order of working numbers with respect to the carbonization chambers without providing any operation interrupting time between the unit oven working steps and an interruption step of interrupting the unit oven working steps until the the carbonization chamber of the coke oven which has been first subject to the unit oven working step reaches a time at which discharge from the carbonization chamber is made possible.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE INVENTION

Now, a method for operating a coke oven according to the present invention will be described hereinafter.

Figures 1A, 1B:
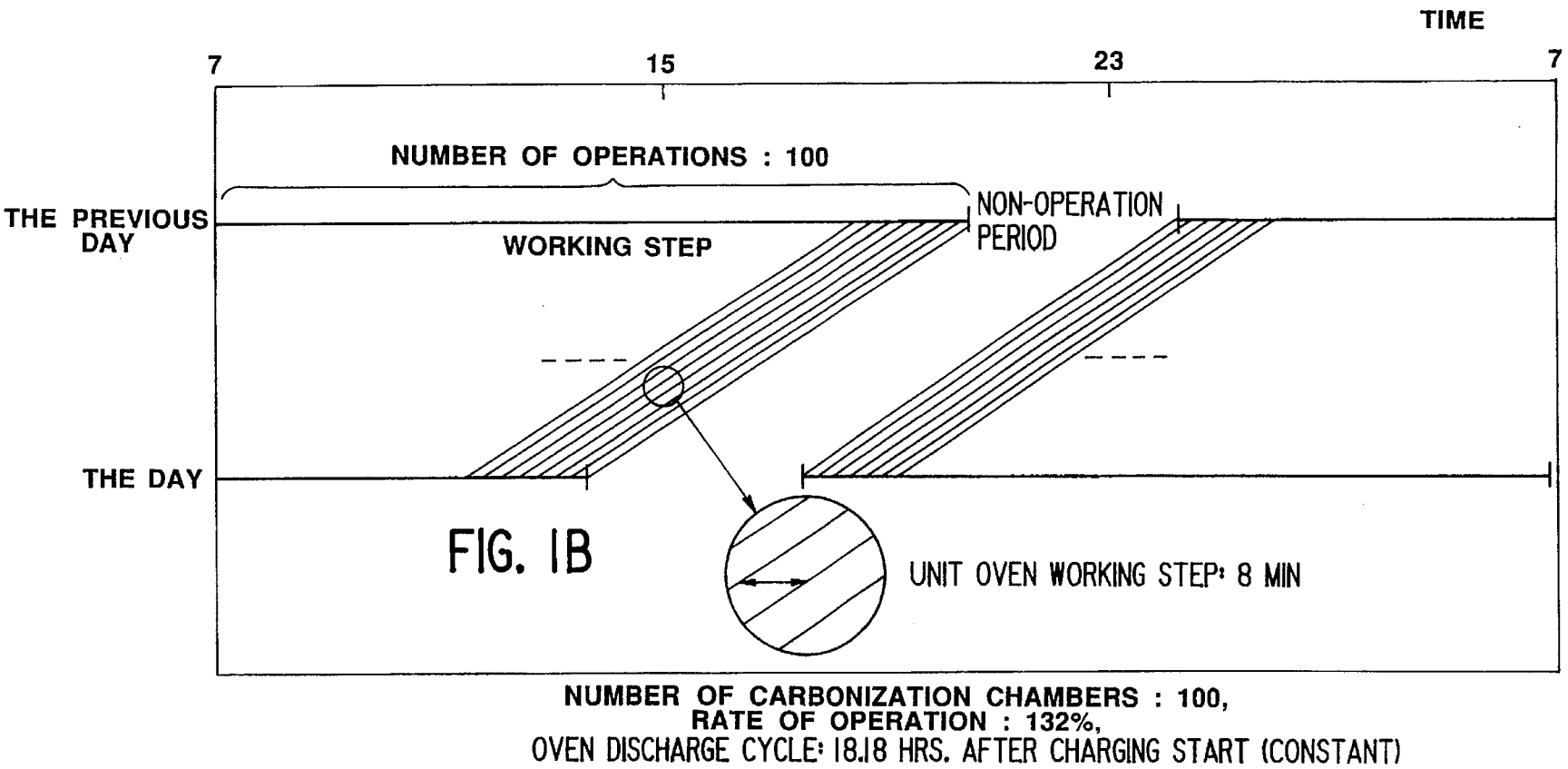
FIG. 1 is a diagrammatic view showing an oven discharge schedule for practicing a method for operating a coke oven battery according to the present invention.

Supposing that a method for operating a coke oven according to the present invention is practiced using a coke oven battery including 100 carbonization chambers under the conditions that the number of operations per one day is 132 and a time required for one unit oven working step is set to be 8 minutes, an oven charge-discharge schedule is as shown in FIG. 1.

The operation under the above-described conditions permits an oven discharge cycle for every carbonization chamber to be 18.18 hours throughout all the carbonization chambers, to thereby be rendered free of a variation in oven discharge cycle, although actually a variation as small as several minutes would occur depending on a position of the carbonization chambers and possible minor troubles. In the operation, a working step amounts to 13.33 hours (8 minutes×100 times) and an interruption step amounts to 5.54 hours. A rest for a working team during the working step is ensured by staggering a rest period for workers of the working team, and shifting between working teams is ensured by overtime or extra work of the previous working team. The extra working can be satisfactorily carried out without charging any excessive work load to workers because routine extra work by three working shifts such as an oven inspection, a cleanup operation, various kinds of education and training, and the like can be carried out during the interruption step, resulting in preventing an increase in extra work. Also, the schedule provides workers of three working shifts with another margin sufficient to permit them to carry out an inspection of the installation as well as the above-described work during the interruption step.

The interruption step overlaps a routine day shift of which working hours is, for example, from 8:30 to 17:00 at a cycle of 4 to 5 days. Such overlapping can be used for repairing the whole coke oven. Maintaining of such a repairing time substantially reduces a variation in oven discharge cycle and a decrease in production of coke caused when a repairing time is secured in lump in each of the first to fourth conventional processes described above. For example, supposing that repairing of the coke oven is carried out for about 5 hours at the rate of 2 times per month in each of the first to fourth conventional processes, a decrease in production occurs in the ratio of about 50 to 80 times per month. On the contrary, the method of the present invention causes a decrease in production to be zero per month.

Thus in accordance with the present invention, unit oven working steps (e.g. a charging step as designated by the horizontal "Previous Day" line in FIG. 1) are continuously carried out until all of the ovens of a battery are charged. This requires 13.33 hours for an eight minute unit oven working step with one hundred ovens as discussed earlier. With an 18.18 hour carbonization cycle (i.e. from charge through discharge), the time at which ovens are ready for discharge on a given day are correlated to the time at which charging occurred on the previous day by the oblique lines (e.g. an oven which is ready for discharge at 11.18 hours—a.m. on a given day was charged 18.18 hours previous or 17.00 (5:00 p.m.) of the previous day). The charging of the ovens continues without interruption, however, once the charging of all of the ovens is completed, an interruption step is provided which extends until after the first oven charged is ready for discharge.

Figure 2A:
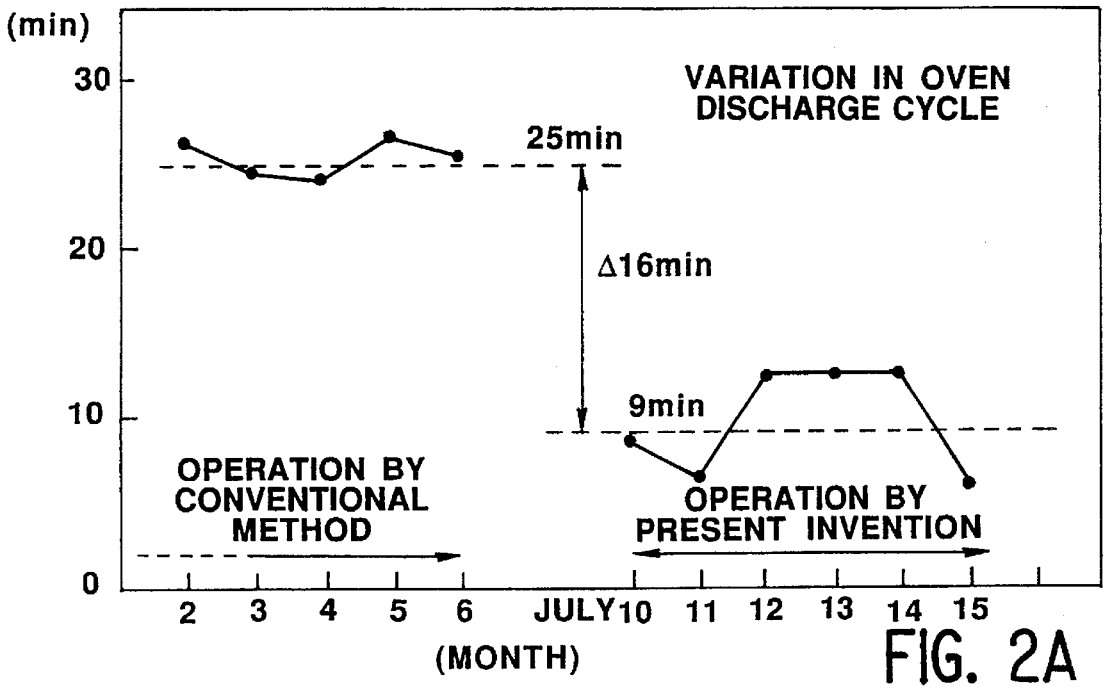
FIG. 2 is a diagrammatic view showing a variation in oven discharge cycle and carbonization time in each of practicing of a prior art and practicing of a method according to the present invention.
Figure 2B:
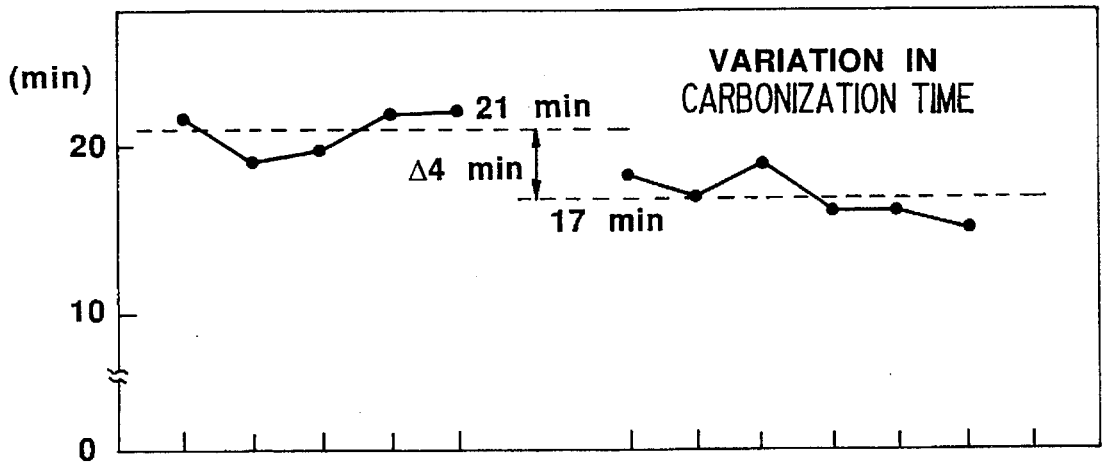
Figure 3:
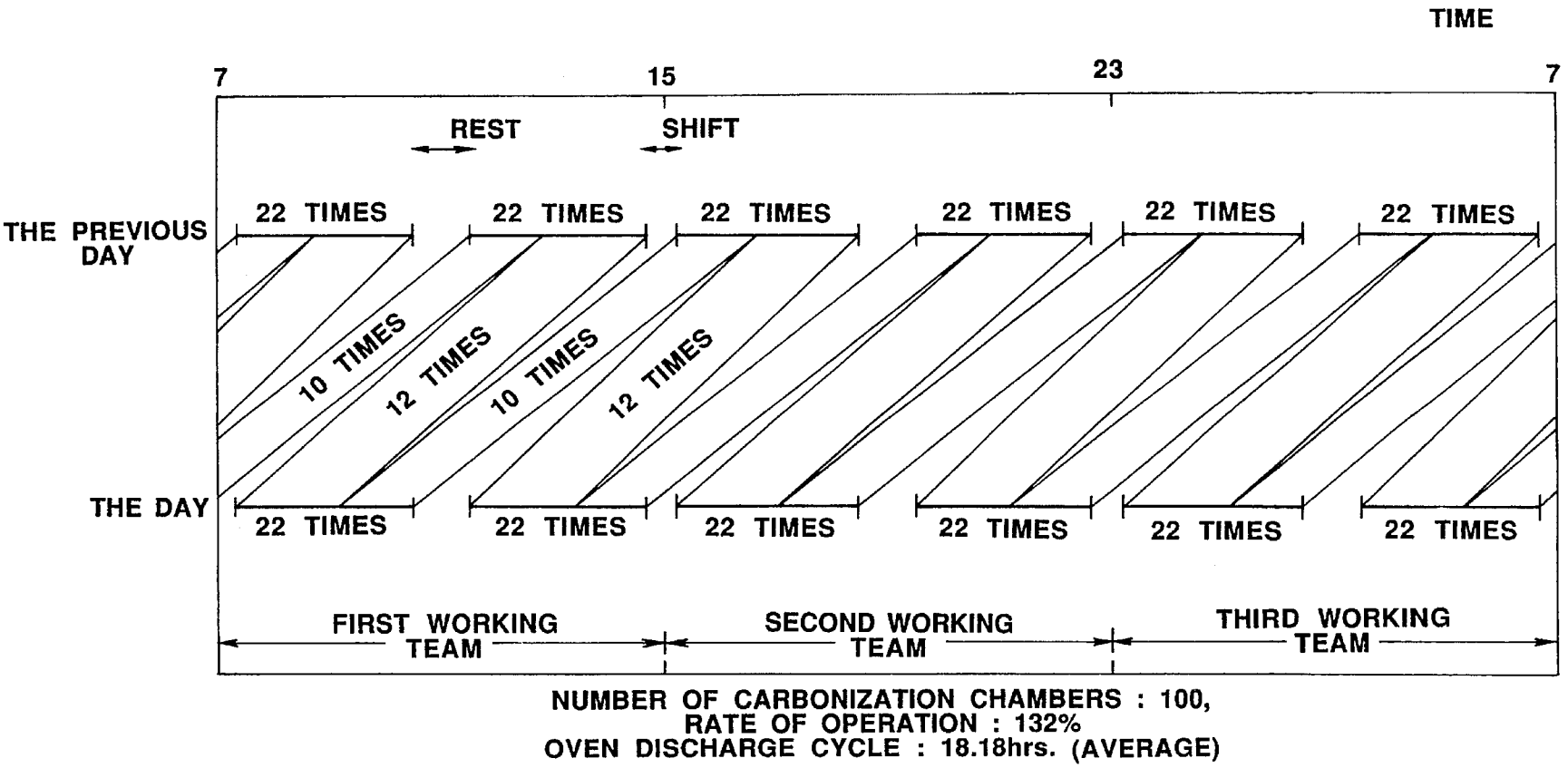
FIG.3 PRIOR ART
FIG. 3 is a diagrammatic view showing a coke oven operation carried out according to a first conventional process.
Figure 4:
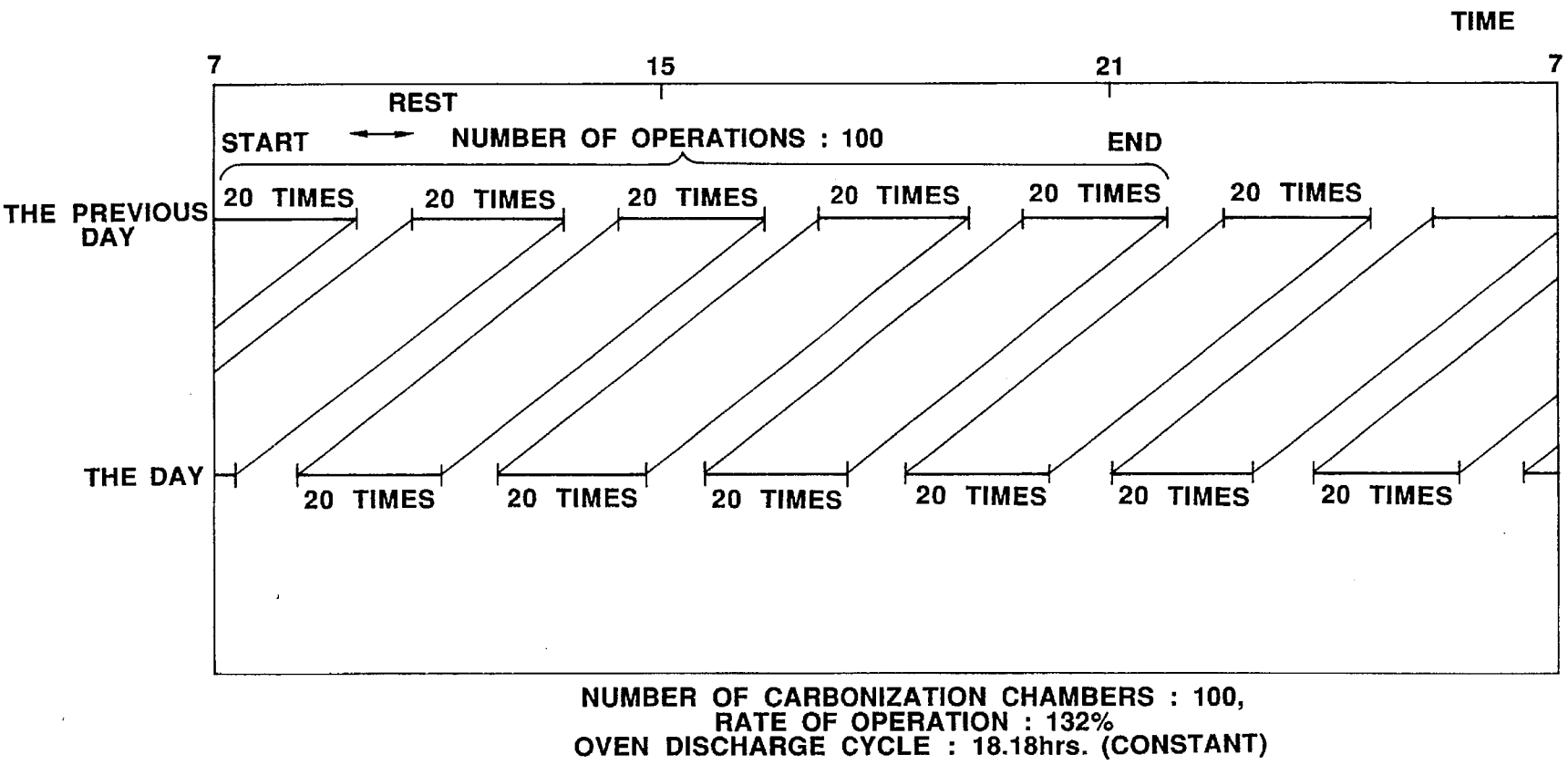
FIG.4 PRIOR ART
FIG. 4 is a diagrammatic view showing a coke oven operation carried out according to a third conventional process.
Figures 5A, 5B:
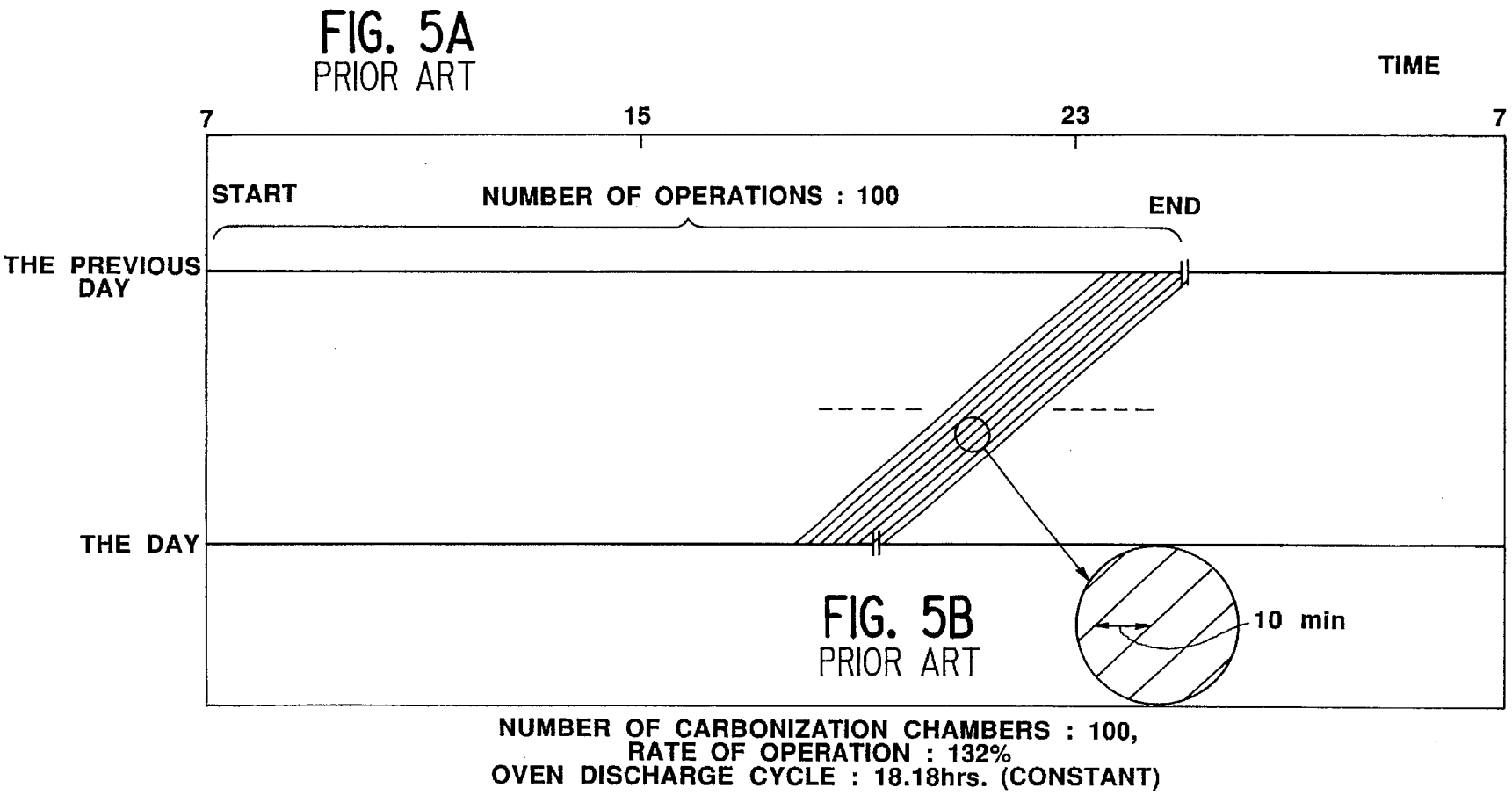
FIG. 5A PRIOR ART
FIG. 5B PRIOR ART
FIG. 5 is a diagrammatic view showing a coke oven operation carried out according to a fourth conventional process.
Figure 6:
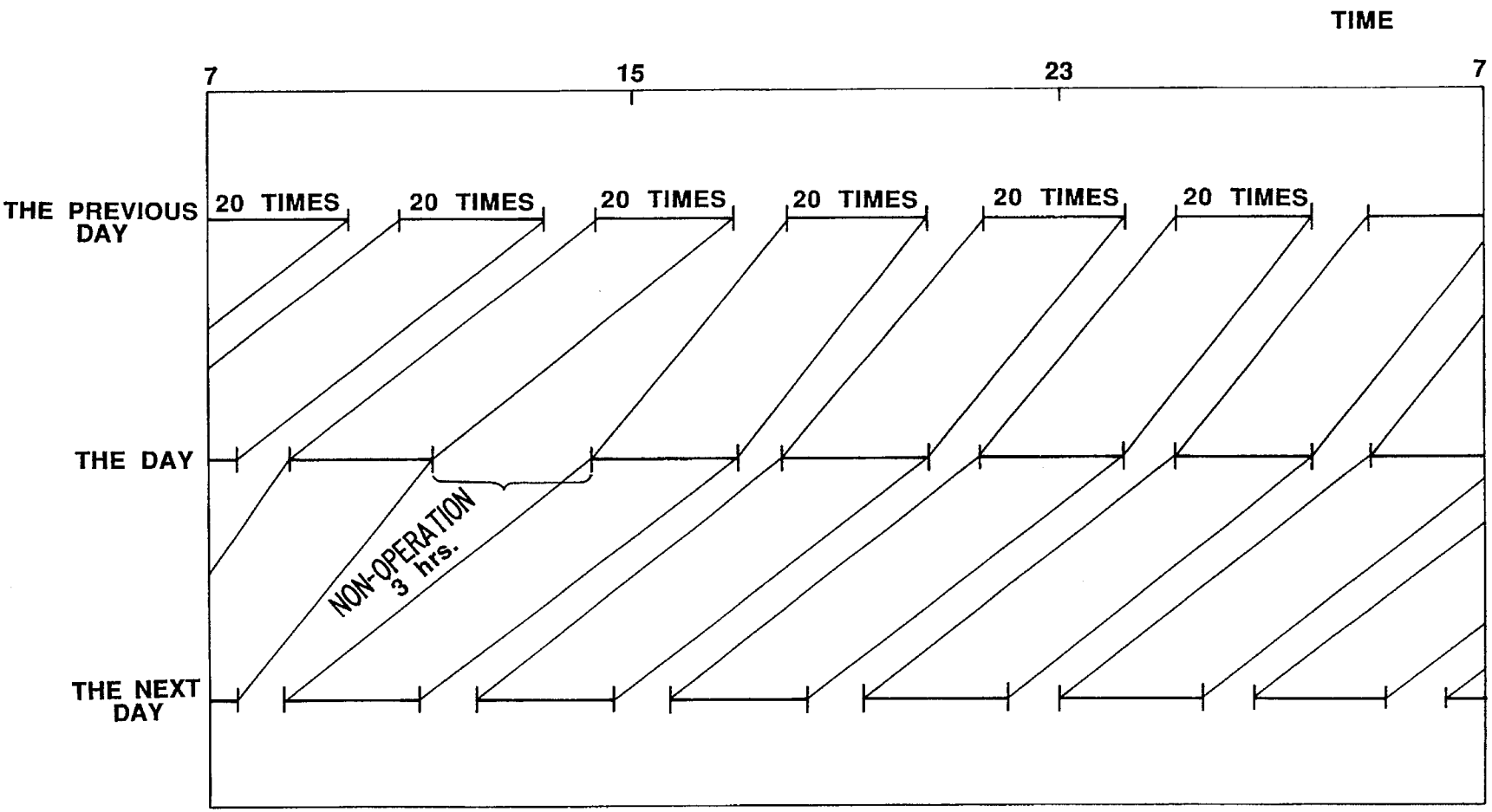
FIG.6 PRIOR ART
FIG. 6 is a diagrammatic view showing a coke oven operation carried out according to a third conventional process, wherein a repairing time of the order of three hours is ensured on the way of the operation.

FIG. 2 is a graphical representation showing a variation in oven discharge cycle time and carbonization time in each of practicing of the prior art or first conventional process and that of the method according to the present invention. FIG. 2 indicates that the present invention permits a variation in oven discharge cycle time to be reduced from 25 minutes to 9 minutes and a variation in carbonization time to be decreased from 21 minutes to 17 minutes.

As can be seen from the foregoing, the method of the present invention decreases a variation in carbonization time, to thereby reduce the quantity of heat required for carbonization and a variation in quality of the product. Also, the present invention substantially restrains a decrease in production due to an coke oven repairing operation.

In addition, the present invention increases a rate of operation of the coke oven without increasing a temperature of the oven, because a decrease in variation of the oven discharge cycle and carbonization time permits excessive carbonization to be reduced, resulting in an increase in production of coke. Further, the present invention permits the operation of the coke oven to be rendered constant by decreasing a temperature of the coke oven, resulting in a life of the coke oven being significantly increased.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A coking process utilizing a battery of coke ovens comprising the steps of:

providing at least 70 coke ovens;

continuously charging said coke ovens with coal from a first oven to at least a seventieth oven without interruption until the at least seventieth oven of said ovens has been charged, and performing a coking operation in each oven of said ovens that have been charged; and interrupting charging of ovens with coal for a period beginning after said at least seventieth oven has been charged, wherein no ovens are charged during said period, wherein said period extends at least until coking is completed in said first oven; and discharging each of said at least seventy ovens continuously after said period and starting with the coke oven first charged.

2. A coking process utilizing a battery of coke ovens comprising the steps of:

providing a plurality of coke ovens;

continuously charging said plurality of coke ovens from a first oven to a last oven without interruption until the last oven of said plurality of ovens has been charged, and performing a coke operation in each of said ovens;

interrupting said charging for a single period after said last oven has been charged, wherein no ovens are charged during said period, wherein said period extends at least until coking is completed in said first oven, and wherein said period lasts at least as long as 5.54 hours.

3. The coking process according to claim 2, wherein:

the number of coke ovens is 100.

4. The coking process according to claim 3, wherein:

the charging of each said coke oven is performed in no more than 8 minutes.

5. The coking process of claim 4, wherein:

the continuously charging step extends for 13.33 hours for all said coke ovens.

6. The coking process according to claim 2, further comprising:

a discharging step for discharging each of the coke ovens continuously immediately after said period and starting with the first coke oven.

7. The coking process according to claim 6, wherein:

a variation of discharge time is on an average of 9 minutes.

8. The coking process according to claim 6, further comprising:

a repairing step for repairing said coke ovens lasting approximately 5 hours and executed during said period.

* * * * *